United States Patent [19]

Ritschel et al.

[11] Patent Number: 4,722,812

[45] Date of Patent: Feb. 2, 1988

[54] SALTS OF ALKENYLSUCCINIC ACID MONOAMIDES

[75] Inventors: Werner Ritschel, Hofheim am Taunus; Hermann Hoffmann, Kelkheim, both of Fed. Rep. of Germany

[73] Assignee: Hoechst Aktiengesellschaft, Frankfurt, Fed. Rep. of Germany

[21] Appl. No.: 818,726

[22] Filed: Jan. 14, 1986

[30] Foreign Application Priority Data

Jan. 16, 1985 [DE] Fed. Rep. of Germany ..... 3501180

[51] Int. Cl.[4] ..... C07C 103/153

[52] U.S. Cl. ..... 260/501.11; 252/392; 562/553

[58] Field of Search ..... 260/501.11; 562/553

[56] References Cited

FOREIGN PATENT DOCUMENTS 3300874 7/1984 Fed. Rep. of Germany .
3319183 11/1984 Fed. Rep. of Germany .
3341013 5/1985 Fed. Rep. of Germany .

*Primary Examiner*—Werren B. Lone
*Assistant Examiner*—Vera C. Clarke

[57] ABSTRACT

Salts of alkenylsuccinic acid monoamides of the formulae

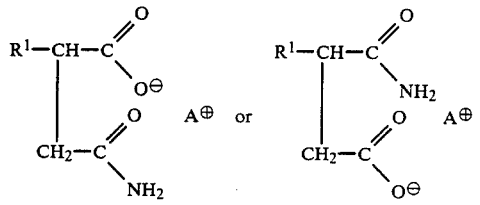

(Ia) (Ib)

wherein $R^1$ is $C_6$–$C_{22}$-alkenyl, preferably $C_9$–$C_{18}$-alkenyl, A is the protonized radical of an amidoamine of the formula II

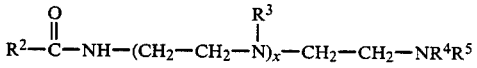

II $R^2$ is $C_5$–$C_{22}$-alkyl, preferably $C_{10}$–$C_{18}$-alkyl, $C_{5-22}$-alkenyl or cycloalkyl, preferably $C_{10}$–$C_{18}$-alkenyl or cycloalkyl, $R^3$ is a group of the formula

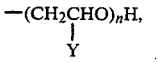

$R^4$ is either a group of the formula —$COR^2$, $R^5$ at the same time being hydrogen, or $R^4$ and $R^5$ at the same time have the same meaning as $R^3$, Y is hydrogen or methyl, n is a number from 0 to 12 and x is a number from 1 to 3. These compounds are suitable as corrosion inhibitors in water-in-oil emulsions, in particular for petroleum and petroleum products.

6 Claims, No Drawings

SALTS OF ALKENYLSUCCINIC ACID MONOAMIDES

The problem of corrosion occurs in all processes of petroleum extraction and refining in which iron or iron-containing metals come into contact with aqueous systems. These problems are particularly severe when the action is by salt water, carbon dioxide and hydrogen sulfide. Corrosion inhibitors mostly used are amines or quaternary ammonium compounds. The protection afforded by the known commercial products is, however, frequently inadequate or it deteriorates after a short time, since the composition of freshly produced crude oil alters continuously. The corrosive constituents increase during extraction particularly when, for example, flooding with salt water is resorted to in order to increase yield. A worldwide need therefore exists for new, more effective corrosion inhibitors and increasing demands are being made.

It has now been found that by using the amidoamine salts of alkenylsuccinic acid monoamides described in what follows, an excellent anticorrosive action can be achieved for water-in-oil emulsions present in petroleum.

Various derivatives of succinic acid are already known as corrosion inhibitors. For example, U.S. Pat. No. 4,053,426 describes alkyl or alkenylsuccinic acid monoesters which are used in the form of the amine salts in lubricants and aqueous metal-working fluids. U.S. Pat. No. 4,235,874 describes alkenylsuCcinic acid or anhydride and triethanolamine triesters as corrosion inhibitors for refined petroleum products. Within the same area of application, U.S. Pat. No. 4,148,605 describes dicarboxylic acid esters which are obtained by reacting alkenylsuccinic anhydride with hydroxycarboxylic acids.

Some succinic acid monoamides are known: thus U.S. Pat. No. 2,490,744 claims reaction products of alkenylsuccinic anhydrides with primary amines in the molar ratio 1.25 to 2:1 as anti-rust agents in lubricants, the total number of carbon atoms in the reaction product being between 28 and 50.

In addition, the German Offenlegungsschrift No. 3,300,874 describes alkanolamine salts of alkenylsuccinic acid monoamides as corrosion inhibitors for aqueous systems; these compounds are prepared by reacting alkenylsuccinic anhydrides with primary $C_1$–$C_{10}$-amines, followed by neutralization with $C_2$–$C_4$-alkanolamines. Other alkenylsuccinic acid monoamides and their use as corrosion inhibitors have been disclosed by German Offenlegungsschriften Nos. 3,319,183 and 3,341,013. The use of succinic acid monoamides as corrosion inhibitors in petroleum extraction and refining has so far not been known.

The subject matter of the invention are salts of alkenyl-succinic acid monoamides of the formulae

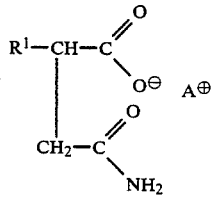

(Ia)

or

-continued

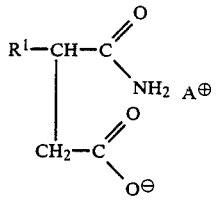

(Ib)

wherein $R^1$ is $C_6$–$C_{100}$-alkenyl, preferably $C_9$–$C_{22}$-alkenyl, A is the protonized radical of an amidoamine of the formula II

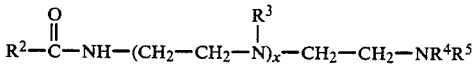

II $R^2$ is $C_5$–$C_{22}$-alkyl, preferably $C_{10}$–$C_{18}$-alkyl, $C_5$–$C_{22}$-alkenyl or cycloalkyl, preferably $C_{10}$–$C_{18}$-alkenyl or cycloalkyl, $R^3$ is a group of the formula

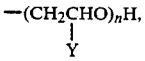

$R^4$ is either a group of the formula —$COR^2$, $R^5$ being at the same time hydrogen, or $R^4$ and $R^5$ have at the same time the same meaning as $R^3$, Y is hydrogen or methyl, n is a number from 0 to 12 and x is a number from 1 to 3. Cycloalkyl under $R^2$ denotes preferably groups derived from naphthenic acids.

The preparation of the salts of the formula Ia and Ib is carried out as follows: firstly, an alkenylsuccinic anhydride is reacted with an excess of ammonia to give the ammonium salts. The reaction can take place with ammonia gas in an inert organic solvent such as petroleum ether or toluene, the ammonium salt crystallizing out; however, the reaction can be carried out equally well with aqueous ammonia, the ammonium salt being obtained as an aqueous solution.

The salts according to the invention can then be prepared from these alkenylsuccinic acid monoamide ammonium salts by heating the latter in aqueous solution at about 100° C. with an amidoamine of the formula II with evolution of ammonia. The amidoamines are prepared by the amidation of carboxylic acids with amines such as diethylene triamine, triethylene tetramine or tetraethylene pentamine at about 150° to 160° C. and, if desired, by subsequent oxalkylation of the products with ethylene oxide or propylene oxide under conventional reaction conditions.

The solutions of the compounds according to the invention obtained in the synthesis can be used directly further without isolating the end product. It is convenient to dilute these solutions with a suitable solvent, for example with a lower alcohol, and to adjust the concentration of the active substance to about 30 to 50%. An addition of these products in commercially available form in amounts from 5 to 100 ppm, preferably 10 to 50 ppm, to petroleum or petroleum products affords a good corrosion inhibiting action.

GENERAL PROCEDURE FOR EXAMPLES 1–4

In a reaction vessel introduce 2 moles of ammonia as an approximately 25% aqueous solution. Slowly and with stirring add dropwise 1 mole of an alkenylsuccinic anhydride, the temperature inside the vessel being maintained at 0°–5° C. by cooling. Stirring is maintained for a further 2 hours at room temperature, and 1 mole of an amidoamine (formula II) is then added. The temperature is then raised to 100° C. with evolution of ammonia and water is removed by distillation. After 2 hours, the mixture is allowed to cool and the desired solvent (for example isobutanol or methanol) is added and the solution is decanted.

Example 1

Following the general procedure, 136 g (2 moles) of 25% ammonia is first reacted with 224 g (1 mole) of tripropenylsuccinic anhydride. 607 g (1 mole) of the amidoamine $II_1$ (prepared from 2 moles of tallow acid and 1 mole of diethylene triamine) are added

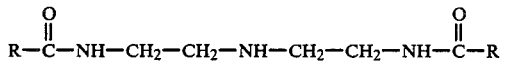

$II_1$

R=the alkyl chain of tallow acid and the general procedure is then again followed. At the end of the reaction, 848 g of isobutanol are added; a yellow solution with a 50% active substance content is obtained.

Example 2

Following the general procedure, 136 g (2 moles) of 25% ammonia is reacted with 266 g (1 mole) of tetrapropenylsuccinic anhydride. 780 g (1 mole) of the amidoamine $II_2$ (prepared from 2 moles of naphthenic acid, 1 mole of diethylene triamine and 3 moles of ethylene oxide) are added

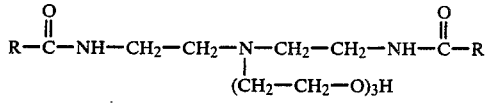

$II_2$

R=alkyl skeleton of naphthenic acid and the general procedure is then again followed. At the end of the reaction 1,060 g of methanol are added; a brown solution with a 50% active substance content is obtained.

Example 3

Following the general procedure, 136 g (2 moles) of 25% aqueous ammonia is firstly reacted with 224 g (1 mole) of tripropenylsuccinic anhydride. 1,020 g (1 mole) of the amidoamine $II_3$ (prepared from 2 moles of tallow acid, 1 mole of triethylene tetramine and 6 moles of propylene oxide) are added

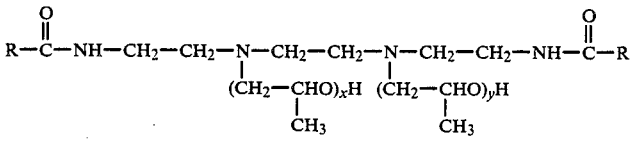

$II_3$

R=the alkyl chain of tallow acid, $x+y=6$, and the general procedure is then again followed. After the addition of 1,255 g of methanol, a brown solution with a 50% active substance content is obtained.

Example 4

Following the general procedure, 136 g (2 moles) of 25% aqueous ammonia are reacted firstly with 350 g (1 mole) of octadecenylsuccinic anhydride. 1,250 g (1 mole) of the amidoamine $II_4$ (prepared from 2 moles of tallow acid, 1 mole of tetraethylene pentamine and 12 moles of ethylene oxide) are then added

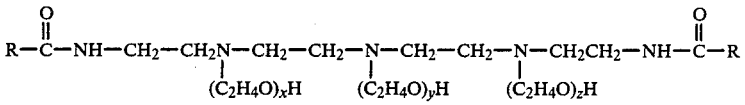

$II_4$

R=the alkyl chain of tallow acid, $x+y+z=12$, and the general procedure is then again followed. After the addition of 1,600 g of isobutanol, a brown solution with a 50% active substance content is obtained.

Example 5

Following the general procedure, 136 g (2 moles) of 25% ammonia is firstly reacted with 224 g (1 mole) of tripropenylsuccinic anhydride. 385 g (1 mole) of the amidoamine $II_5$ (prepared from 1 mole of naphthenic acid and 1 mole of diethylene triamine) are then added

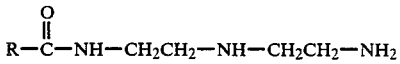

$II_5$

R=the alkyl skeleton of naphthenic acid and the general procedure is then again followed. At the end of the reaction 625 g of toluene are added; a brown solution with a 50% active substance content is obtained.

The tests described below demonstrate the outstanding corrosion inhibiting properties of this class of compounds. The commercial products Visco 938 and Servo CK 378 were tested at the same time for comparison.

For the testing of the inhibitor compositions, a dynamic test (so-called "wheel-test") was used, this being a method used for testing corrosion inhibitors for petroleum and natural gas extraction.

The coupons chosen for the test were steel strips measuring 130 mm×10 mm×1 mm. There were sandpapered, degreased with toluene and weighed. The test medium used was kerosene containing emulsified salt water with a 5% by weight sodium chloride content based on the water. The emulsion contained 90% by weight of salt water and was saturated with hydrogen sulfide or carbon dioxide.

The inhibitor was then added in quantities of 10, 20 and 50 ppm, based on the weight of the emulsion.

The degreased and weighed strips were then immersed in the emulsion and subjected to mechanical motion (40 rpm with the aid of a shaft rotating the test containers) at 70° C. for 24 hours.

The test strips were subsequently cleaned with an inhibiting acid, degreased and weighed after being dried in order to determine the loss of weight. The corrosion rates are indicated in mpy (mills per year) (39.4 mpy=1 mm/year). A blank (test without addition of inhibitor) was obtained for comparison.

The table which follows summarizes the results obtained by this test method.

Results of the wheel test
70° C., 24 hours, salt water (5%) kerosene 9:1, corrosion rates in mpy

| | $CO_2$ (pH = 3,5 with acetic acid) | | | $H_2S$ | | |
|---|---|---|---|---|---|---|
| | 10 | 20 | 50 ppm | 10 | 20 | 50 ppm |
| Example 1 | 4.5/3.9 | 2.4/1.8 | 1.2/1.0 | 2.3/1.8 | 2.0/1.8 | 0.5/1.0 |
| 2 | 4.6/4.9 | 3.2/3.0 | 3.0/2.5 | 6.3/5.2 | 3.5/4.2 | 2.8/3.0 |
| 3 | 6.3/5.2 | 3.4/4.0 | 3.4/3.4 | 10.6/11.7 | 5.3/4.7 | 2.8/3.2 |
| 4 | 7.8/7.2 | 4.7/4.6 | 3.4/3.8 | 10.5/11.2 | 9.2/8.6 | 3.7/4.0 |
| 5 | 4.4/4.0 | 2.4/1.9 | 1.3/1.1 | 2.3/1.9 | 2.0/1.8 | 0.4/1.0 |
| Visco 938 | 26.6/25.4 | 18.6/20.0 | 8.4/6.4 | 16.4/19.0 | 8.8/10.4 | 3.6/4.0 |
| Servo CK 378 | 14.0/12.3 | 5.2/4.6 | 3.4/4.5 | 16.0/13.5 | 10.3/10.0 | 3.5/5.0 |
| Blank | 25.3 ± 6.1 (10 values) | | | 51.3 ± 4.9 (10 values) | | |

We claim:

1. A salt of an alkenylsuccinic acid monoamide of the formulae

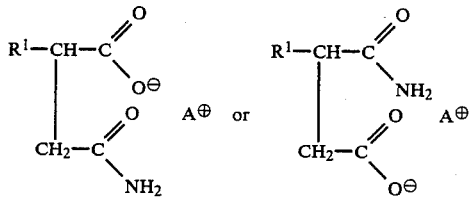

(Ia) (Ib)

wherein $R^1$ is $C_6$–$C_{22}$-alkenyl, A is the protonized radical of an amidoamine of the formula II

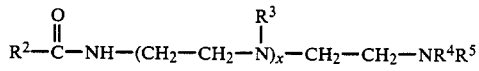

II $R^2$ is $C_5$–$C_{22}$-alkyl, $C_5$–$C_{22}$-alkenyl or cycloalkyl, $R^3$ is a group of the formula

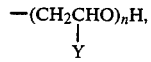

$R^4$ is either a group of the formula —$COR^2$, $R^5$ at the same time being hydrogen, or $R^4$ and $R^5$ at the same time have the same meaning as $R^3$, Y is hydrogen or methyl, n is a number from 0 to 12 and x is a number from 1 to 3.

2. A salt as claimed in claim 1, wherein $R^1$ is $C_9$–$C_{18}$-alkenyl.

3. A salt as claimed in claim 1, wherein $R^2$ is $C_{10}$–$C_{18}$-alkyl.

4. A salt as claimed in claim 1, wherein $R^2$ is $C_{10}$–$C_{18}$-alkenyl or cycloalkyl.

5. A salt as claimed in claim 2, wherein $R^2$ is $C_{10}$–$C_{18}$-alkyl.

6. A salt as claimed in claim 2, wherein $R^2$ is $C_{10}$–$C_{18}$-alkenyl or cycloalkyl.

* * * * *